US008360544B2

(12) United States Patent
Kayahara

(10) Patent No.: US 8,360,544 B2
(45) Date of Patent: Jan. 29, 2013

(54) PRINT CONDITION SETTING METHOD IN PRINTING DEVICE

(75) Inventor: Naoki Kayahara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 199 days.

(21) Appl. No.: 13/005,942

(22) Filed: Jan. 13, 2011

(65) Prior Publication Data

US 2011/0175961 A1 Jul. 21, 2011

(30) Foreign Application Priority Data

Jan. 18, 2010 (JP) ..... 2010-007885

(51) Int. Cl.
*B41J 29/38* (2006.01)
*B41J 2/205* (2006.01)
*B41J 2/155* (2006.01)

(52) U.S. Cl. ..... 347/15; 347/13; 347/42

(58) Field of Classification Search ..... 347/15
See application file for complete search history.

(56) References Cited

U.S. PATENT DOCUMENTS

2005/0200641 A1* 9/2005 Tanaka et al. ..... 347/13
2009/0179924 A1 7/2009 Okada et al.

FOREIGN PATENT DOCUMENTS

JP 2009-166297 A 7/2009

* cited by examiner

*Primary Examiner* — Uyen Chau N Le
*Assistant Examiner* — Kajli Prince
(74) *Attorney, Agent, or Firm* — Global IP Counselors, LLP

(57) ABSTRACT

In a printing device includes a plurality of heads corresponding to black K ink and colored inks C, M, and Y, wherein the heads are extended in a direction orthogonal to a conveying direction of a medium and are disposed in parallel from the upstream side to the downstream side, and ink droplets are discharged and deposited on the medium in order from the heads while the medium is being conveyed, a print condition setting method includes the steps of setting an order in accordance with the extent of concentration irregularity in the composite colors RGB; and creating, within the discharge order of the inks, the most separation of discharge order between the two colored inks that manifest the composite color having the greatest concentration irregularity, and inserting K ink between the discharge orders of the two colored inks that manifest the composite colors having the second greatest concentration irregularity.

6 Claims, 8 Drawing Sheets

PRINT CONDITION SETTING METHOD IN PRINTING DEVICE

CROSS-REFERENCE TO RELATED APPLICATIONS

This application claims priority to Japanese Patent Application No. 2010-007885 filed on Jan. 18, 2010. The entire disclosure of Japanese Patent Application No. 2010-007885 is hereby incorporated herein by reference.

BACKGROUND

1. Technical Field

The present invention relates to a method for setting print conditions in an inkjet printer or another printing device for intermittently discharging ink onto a medium and depositing the ink at a target position on the medium.

2. Related Art

One known example of a printing device is an inkjet printer, which performs printing by intermittently discharging ink onto paper, cloth, film or other various media. An inkjet printer forms an image by depositing tiny dots composed of ink droplets on a medium. An inkjet printer comprises an ink discharge head in which nozzles from which ink is discharged are fixed in place in a line or staggered formation across the width of the medium, and forms an image by discharging ink while moving the medium in a conveying direction orthogonal to the line direction in which the nozzles are aligned. The ink is loaded into an ink tank, led from the tank to a space referred to as a reservoir in the head by a pump, and then guided from the reservoir to a pressure chamber in communication with the nozzles. The pressure chamber is then expanded and contracted or otherwise manipulated, causing the ink to be discharged from the nozzles. The ink droplets discharged from the nozzles are thereby deposited onto a target position on the surface of the medium.

In an inkjet printer capable of printing in multiple colors using a plurality of ink colors, droplets of the plurality of inks are mixed by subtractive color mixing on a plane to express colors other than the ink colors, known as composite colors or secondary colors. In the printing areas of composite colors, bordering ink droplets of inks of two different colors flow together on the medium and blur along the fibers or the like of the medium, the solvent (moisture) of water-based ink seeps into the medium and deforms the medium, the ink droplets deposited at one time on the medium agglutinate, and a phenomenon known as "concentration irregularity" has been known to occur, wherein the concentration of a composite color becomes non-uniform.

In Japanese Laid-Open Patent Publication No. 2009-166297, a printing device is disclosed in which non-water-based ink is first discharged and water-based ink is then discharged in order to prevent concentration irregularity resulting from deformation of the medium.

SUMMARY

According to the technique disclosed in Japanese Laid-Open Patent Publication No. 2009-166297, it may be possible to prevent concentration irregularity in regular paper or other paper which readily stretches as a result of the aqueous solvent of the ink. However, as described above, there are various causes of concentration irregularity, and the inks used in printing devices have various physical properties. There are, of course, also various type of media. For example, concentration irregularity resulting from the ink droplets agglutinating on the medium is well known in so-called printing paper, which is a medium coated on the surface for commercial printing, and it is not possible to prevent concentration irregularity resulting from other causes. That is, there are currently no printing techniques which exhibit a comprehensive effect against concentration irregularity resulting from various causes.

The present invention was devised in view of the problems described above, and a primary aspect thereof is a method for setting print conditions in a printing device including a conveying mechanism of a medium and a plurality of heads for discharging inks out of nozzles, the inks including at least black ink and inks of the three colors including cyan, magenta, and yellow, wherein heads extend across the width of the medium in a line direction orthogonal to the conveying direction of the medium, the heads are disposed in parallel from an upstream side to a downstream side, and a color image is formed by ink droplets being discharged in order from the heads and deposited on the medium while the medium is being conveyed. The print condition setting method in a printing device includes: setting an order of the extent of concentration irregularity for three composite colors including red, green, and blue expressed by combining two of the three colored inks; and creating the most separation between the two colored inks that express the composite color having the greatest concentration irregularity, based on the order for discharging the black ink and the three colored inks in the printing device, and placing the discharge order of the black ink between the two colored inks that express the composite color having the second greatest concentration irregularity. Other characteristics of the present invention are clarified by the descriptions in the Specification and the accompanying drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
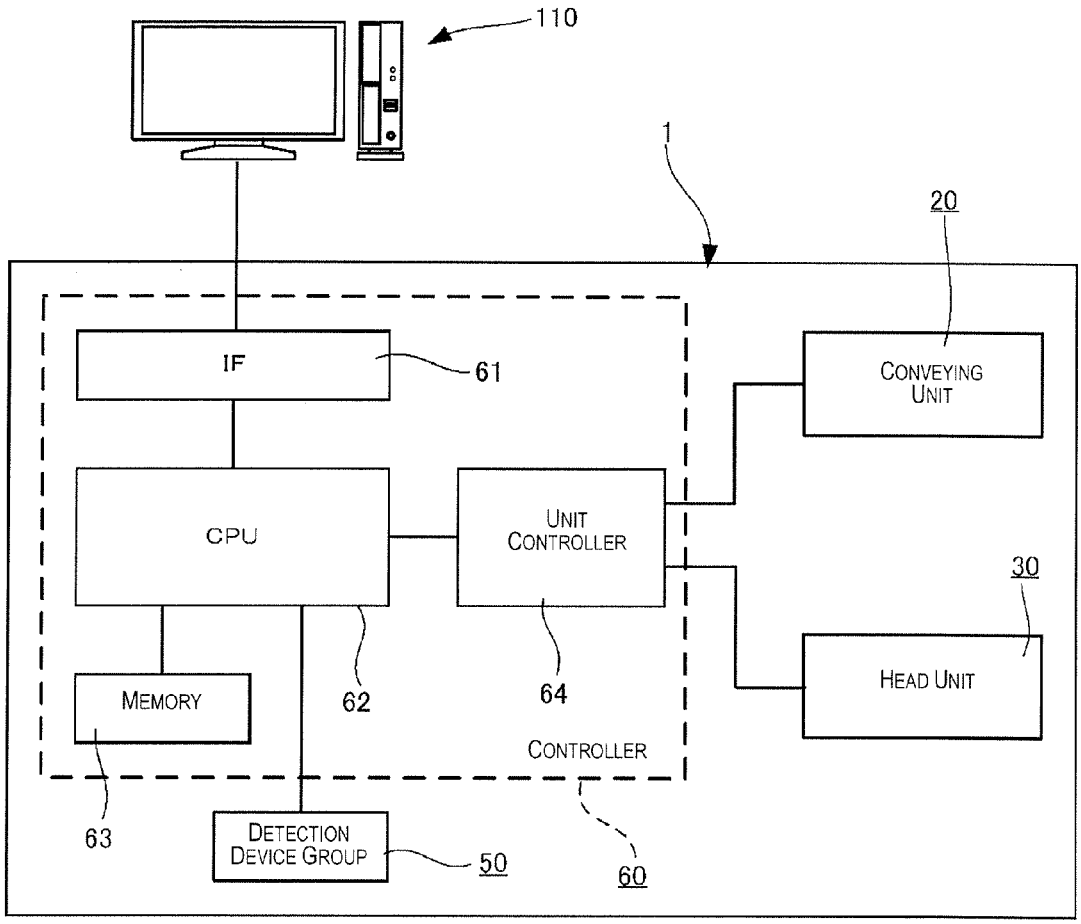
FIG. 1 is a block diagram showing the overall configuration of a printer in an embodiment of the present invention.

As described above, in an inkjet printer or another printing device which forms an image by discharging ink onto a medium and uses a plurality of ink colors in order to perform multicolored printing, a combination of various factors causes concentration irregularity. For example, the extent of concentration irregularity differs greatly depending on the physical properties of the ink used, the type of medium, and other factors. In view of this, the inventors have determined that it would be practical and efficient to examine concentration irregularity countermeasures that are suited to the specifications of the printing device (the ink used and the like), the applications of printed object, and other factors by seeking a solution for removing the root cause of concentration irregularity.

The present invention, which is based on the results of these examinations, is embodied as a printing device as a single element or a printing device as a system that includes a printing device and an information processing device (e.g., a personal computer) for controlling the printing device, and a working example of the present invention is a method in which these embodiments are used to set the print conditions of the printing device so that concentration irregularity is not noticeable. The working example of the present invention comprises the following characteristics in addition to the characteristics of the working example corresponding to the primary aspect described above.

The concentration irregularity rank setting steps previously described include a step of printing a test image which individually includes printing areas of the composite colors R, G, and B over at least a predetermined surface area on a medium, and a step of analyzing the test image and detecting the extent of concentration irregularity in the printing areas of the composite colors.

In the discharge sequence setting steps described above, which include a step for printing the desired image indicated by the user and a step of analyzing the desired image and detecting the extent of concentration irregularity of the composite colors, the desired image is analyzed and the sequence is set according to the extent of concentration irregularity.

The printing device comprises a head switching mechanism for causing the desired head to discharge ink of the desired color, according to operation by the user. Furthermore, a step is included for outputting to the user a display of the discharge sequence set according to the previously-described discharge sequence setting steps.

The conveying mechanism is capable of conveying the medium in two directions, the heads corresponding to the respective inks of the colors C, M, Y, and K are disposed in a predetermined sequence upstream to downstream, and in the discharge sequence setting steps, the medium is conveyed in the forward and reverse directions to the ink discharge positions of the heads corresponding to the respective inks of the colors C, M, Y, and K, according to the discharge sequence.

Basic Embodiment

Figure 2A:
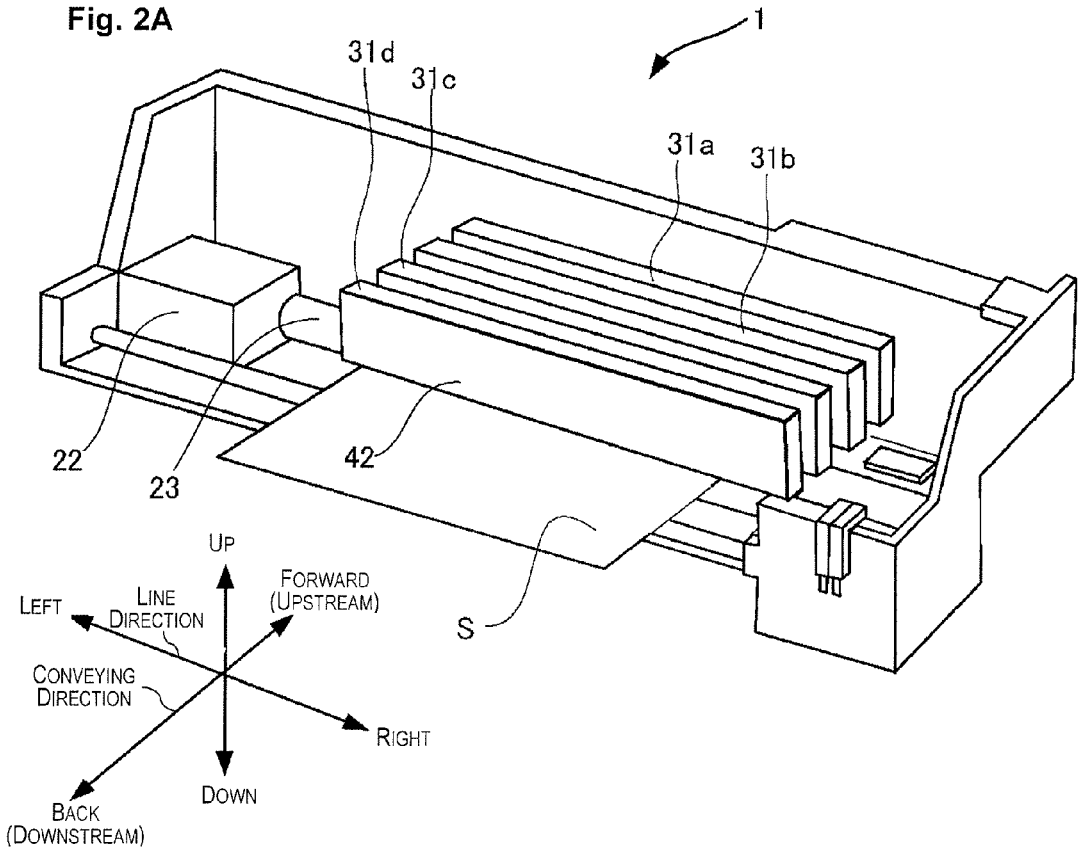
FIG. 2A is a partially cutaway perspective view of the overall configuration of the printer, 2B is a transverse cross-sectional view of the overall configuration of the printer.
Figure 2B:
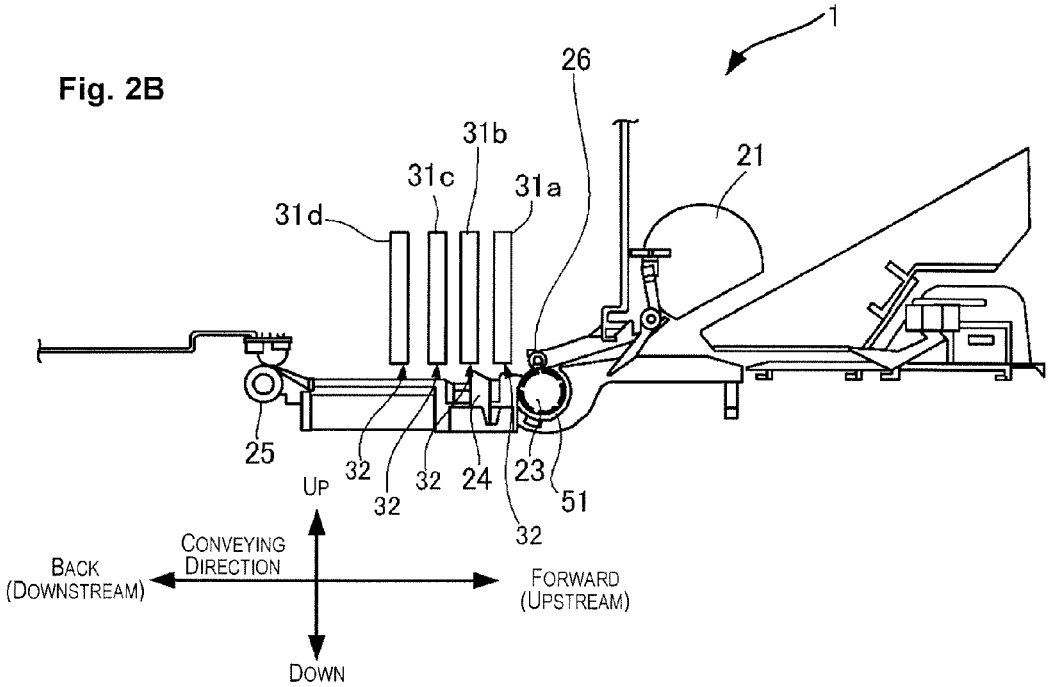

First is a description of the printing device or printing system as an embodiment of the present invention, the basic configuration or structure thereof, and the action thereof. FIG. 1 is a functional block diagram of the printing device according to the basic embodiment of the present invention. FIG. 2 shows the schematic structure of the printer 1. FIG. 2A is a cutaway perspective view of the printer 1, and FIG. 2B is a transverse cross-sectional view of the printer 1. The printer 1 shown herein is a line printer in which the head is disposed so as to extend along the width direction of the medium (hereinbelow referred to as the line direction), and the printer's basic configuration includes a conveying unit 20, a head unit 30, a detection device group 50, and a controller 60.

The controller 60 is a control unit for performing control on the printer 1, and is configured including a CPU 62 as a computation processing device, and a RAM, EPROM, or other storage element. The controller 60 is also configured including memory 63 for saving the storage areas of the programs run by the CPU 62, the operative areas of these programs, and various data processed by these programs; a unit controller 64 for conducting data communication between the units (20, 30) and the CPU 62 and driving these units (20, 30); an interface (IF) 61 for conducting data transmission between the printer 1 and the personal computer or other external device (hereinbelow referred to as a PC) 110; and other components.

The detection device group 50 includes various sensors for detecting the various states within the printer 1, and the sensors included in the detection device group 50 output the detection results (detection data) to the controller 60. The detection device group 50 includes a rotary encoder 51 or the like for detecting the rotational speed of a conveying roller 23, for example.

The conveying unit 20 is used to convey paper or another medium S in a predetermined direction (hereinbelow, the conveying direction). The conveying unit 20 has a paper-feeding roller 21, a conveying motor 22, a conveying roller 23, a platen 24, a paper-ejecting roller 25, and other components as its primary constituent elements. The paper-feeding roller 21 is a roller for feeding a medium S into the printer 1 after the medium S has been inserted into an insertion port. The aforementioned conveying roller 23 is a roller for sandwiching the medium S with a driven roller 26 and conveying the medium S fed by the paper-feeding roller 21 to a printable area, and is driven by the conveying motor 22. The controller 60 can detect the rate of movement of the medium S on the basis of the rotational speed of the conveying roller 23.

The platen 24 is for supporting the medium S during printing. The paper-ejecting roller 25 is provided downstream in the conveying direction from the printable area, and is a roller for sandwiching the medium S with a driven roller 27 and ejecting the medium S out of the printer 1. The paper-ejecting roller 25 rotates in synchronization with the conveying roller 23. The conveying roller 23 and the paper-ejecting roller 25 are both designed so that their circumferential length is one inch, so that the amount of conveying is one inch per rotation.

The head unit 30 is configured for discharging ink onto the medium, and is provided with a plurality of heads (31*a* to 31*d*) comprising nozzles. In this example, four heads (31*a* to 31*d*) are provided corresponding to the respective inks of the four colors black (K), cyan (C), magenta (M), and yellow (Y). The four heads (31*a* to 31*d*) are disposed parallel to the conveying direction of the medium S. In addition to these heads (31*a* to 31*d*), the head unit 30 also includes an ink tank, a pump for supplying ink from the ink tank to the heads, and other components. In the present working example, the plurality of colored inks for performing multicolored printing are filled in individual ink tanks. The inks of the colors C, M, and Y are hereinbelow referred to as "colored inks" and are distinguished from K ink.

By executing the programs stored in the memory 63, the CPU 62 in the controller 60 process print data received from the computer 110 via the IF 61, detection data from the detection device group 50, and other data; and controls the units (20, 30) via the unit controller 64 on the basis of the processing results. A printed image is thereby formed on the medium S.

Figure 3:
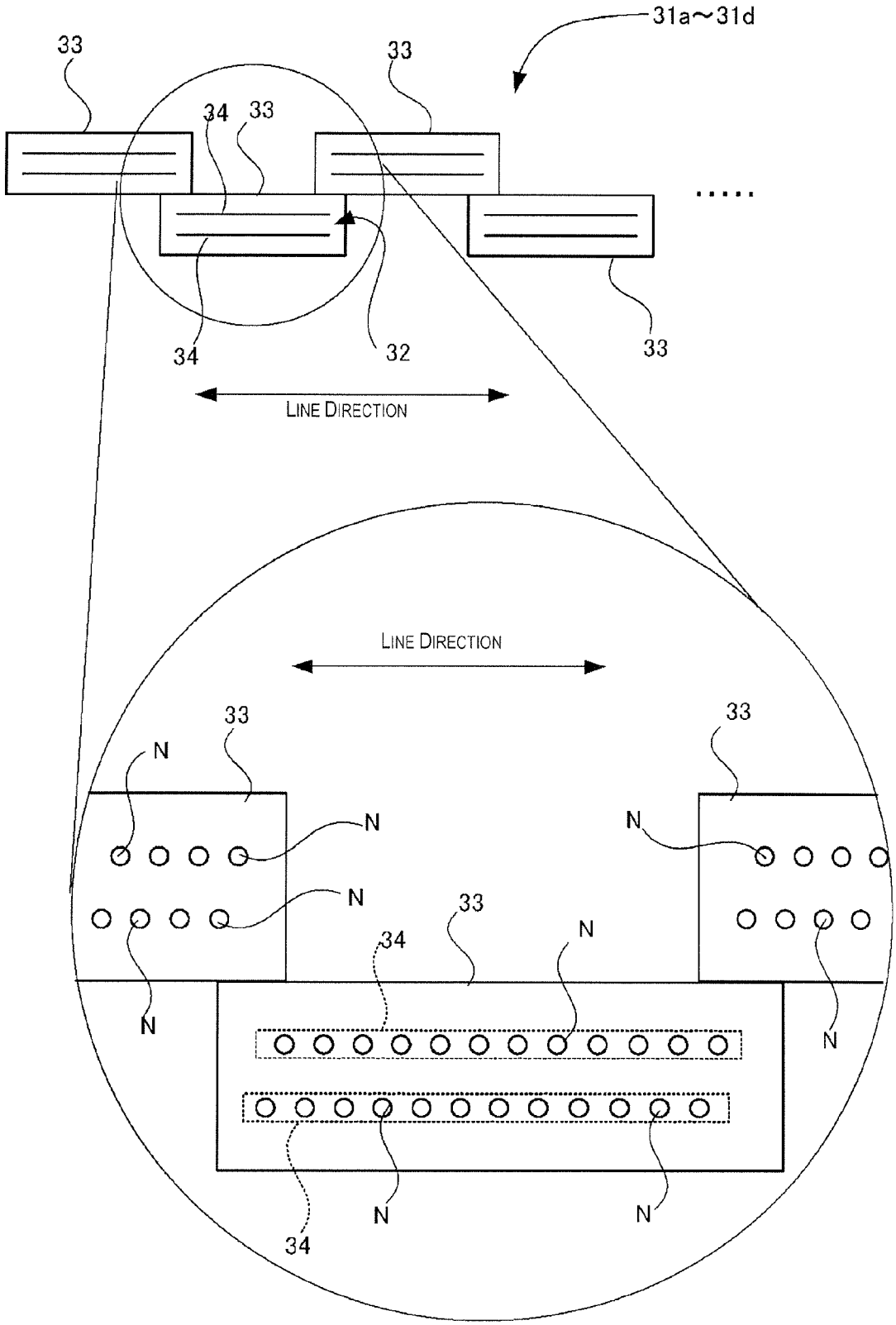
FIG. 3 is a drawing showing the nozzle alignment of the heads constituting the printer.
Figure 4A:
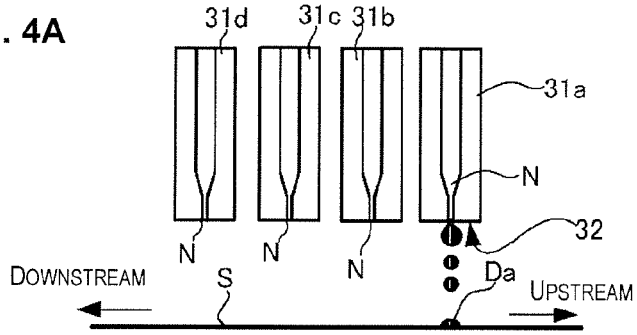
FIGS. 4A to 4D are schematic drawings showing the printing action in the printer.
Figure 4B:
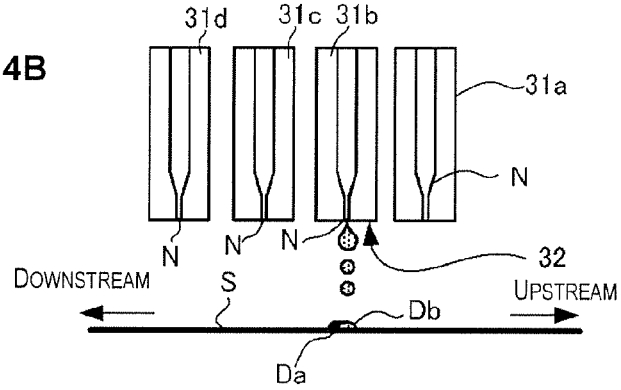
Figure 4C:
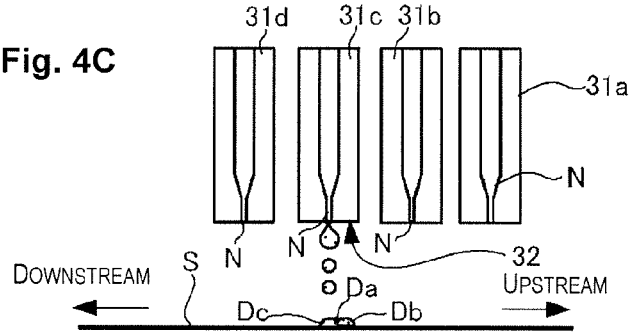
Figure 4D:
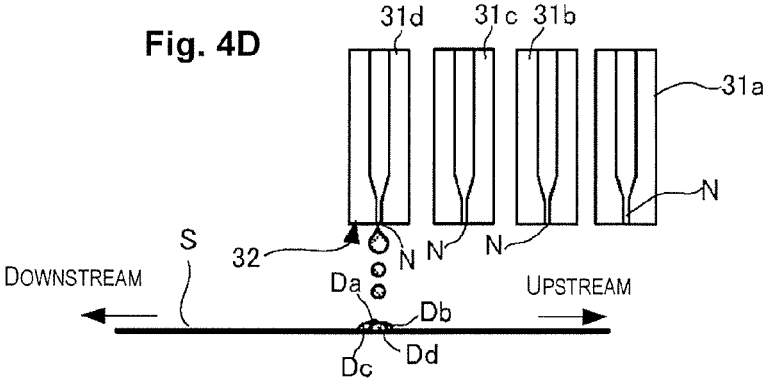

The printer 1 forms the printed image by colored ink droplets, the head unit 30 is configured for discharging the ink droplets onto the medium S, and a plurality of nozzles are formed in the underside 32 of the heads (31*a* to 31*d*). As described above, the printer 1 uses inks of the four colors K, C, M, and Y, and heads (31*a* to 31*d*) are individually provided for the ink of each color. An example of the structure of the heads (31*a* to 31*d*) is shown in FIG. 3. In this drawing, a plan view is shown with an enlarged view (within the circle) of one arbitrary head 31 of the four heads (31*a* to 31*d*), seen from the underside 32. The heads 31 are disposed in a line formation across the width of the medium S, and the shape thereof is not a simple linear formation, but blocks 33 are configured from predetermined numbers of nozzles N, and the blocks 33 are disposed in a staggered formation in the width direction of the medium S.

Pluralities of nozzles N are formed in the blocks 33, at constant intervals in the line direction. In this example, two nozzle rows 34 are formed in the front and rear. Ink chambers (not shown) and piezo elements are provided respectively for the nozzles N, and when the ink chambers are expanded and contracted by the driving of the piezo elements, ink droplets are discharged from the nozzles N. The heads 31 having this type of configuration discharge ink droplets intermittently while the medium S is being conveyed, whereby dots composed of ink droplets are disposed two-dimensionally onto the medium S and an image is formed on the medium S.

Basic Printing Action

FIGS. 4A through 4D show formation sequence of an image in the printer 1. These drawings show an example of the action for printing the desired image, such as characters, a static image, or the like displayed on the display of the PC 110, for example. The medium S herein is conveyed upstream to downstream. In an inkjet printer, as is conventionally known, intermediate colors are expressed by subtractive color mixing in which droplets of the four colored inks are disposed in an extremely small area on the medium S, and FIGS. 4A to 4D show an action for depositing ink droplets (Da to Dd) of K ink and the colored inks CMY for a total of four colors in an extremely small area on the medium S.

First, when the medium S begins to be conveyed and a specified extremely small area in the medium S faces the underside 32 of the head 31*a* farthest upstream, droplets Da of that color of ink are discharged by the head 31*a* and the droplets Da are disposed on the medium S (A). When the medium S is further conveyed and the first extremely small area moves from the upstream side and faces the underside 32 of the second head 31*b*, droplets Db of the next ink color are discharged by the head 31*b* onto the medium surface (B). Droplets Dc of the third ink color are then similarly deposited during the conveying of the medium S (C), and ink of the fourth color is deposited last (D). An image is thereby formed.

Summary of Concentration Irregularity Countermeasures

As is conventionally known, in an inkjet printer which creates a color image using inks of the four colors CMYK, the three primary colors of light RGB are expressed using any two of the three colored inks other than K, finer intermediate colors are expressed according to the ratios of the respective colors RGB, and the brightness of the intermediate colors is expressed using K. Concentration irregularity arises in areas of printing composite colors of RGB expressed by two colored inks. However, it is difficult to fundamentally resolve the issue of concentration irregularity, because whichever composite color yields the stronger concentration irregularity is due to a combination of various factors as described above.

In view of this, in the print condition setting method for the printing device according to the first working example of the present invention, first, at the point in time when the inks to be used in the printer 1 are established, the composite colors that use those inks are printed in a test pattern or the like, the print area of the composite colors in the printed object is scanned, and a sequence is assigned to the extent of concentration irregularity for the composite colors printed by the printer 1. The structural design of the printer 1, the printing process, and other print conditions are then set according to this sequence. It is thereby possible to effectively prevent concentration irregularity unique to the printer 1.

Specifically, in view of the fact that concentration irregularity occurs when ink of the next color is discharged before the colored ink droplets (Da to Dd) deposited on the medium S flow together, agglutinate, and settle into a certain steady state, the print conditions are set so that first there is as much deviation as possible between the discharge timings of the two colored inks constituting the composite color having the greatest extent of concentration irregularity, and the discharge timings of two colored inks constituting composite colors having a large extent of concentration irregularity are then distanced from each other. The subsequent colored ink is thereby deposited at the point in time when the deposited ink discharged previously has reached a steady state, and concentration irregularity can be effectively prevented. The operations when the order of the extent of concentration irregularity is established and when the ink discharge sequence is established based on this order are described hereinbelow as working examples of the present invention.

First Working Example

As the first working example of the present invention, an example is given for a printer shipped out as a final product, wherein the ink discharge sequence is set on the basis of the basic configuration of the printer 1 shown in FIGS. 1 and 2 and the concept presented in the "Summary of Concentration Irregularity Countermeasures" above in a state in which the inks CMY are used and the medium S is primarily used have been established.

Figure 5:
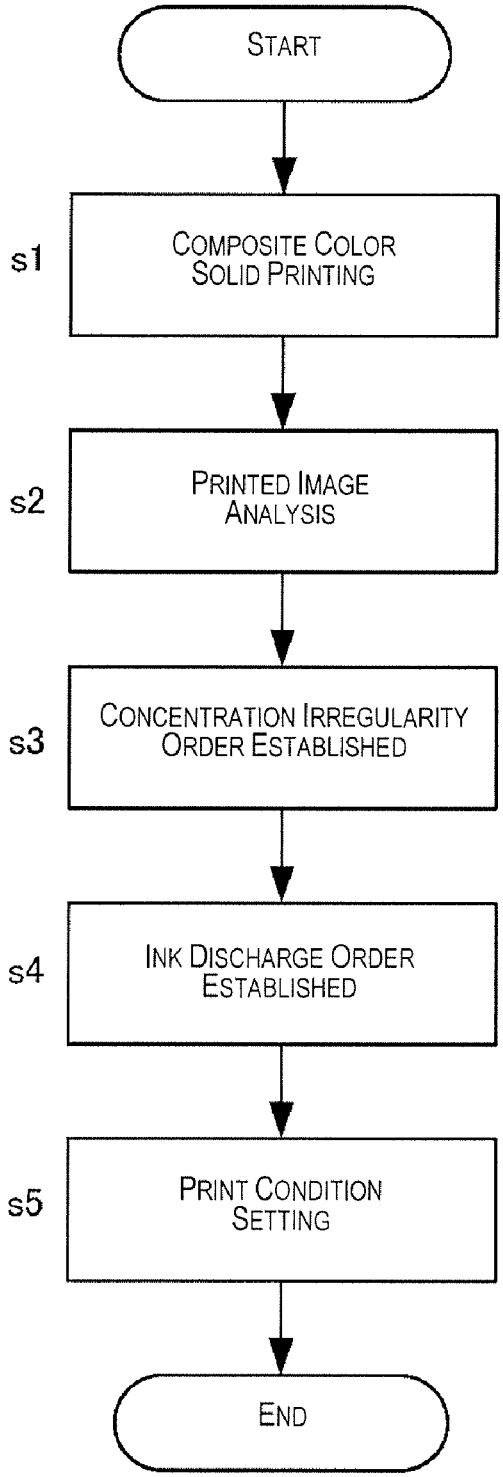
FIG. 5 is a flowchart of the print condition setting method according to the first working example of the present invention.

FIG. 5 shows the flow of the print condition setting method in the first working example. First, in the printing device, an image (test image) is printed including an area (solid area) given a solid coating by the composite colors RGB using two of the three colors CMY (s1). At this time, the composite colors RGB are preferably printed with the same conditions. In view of this, for example, three printers 1 are used, and the printers 1 print one composite color by using two heads (31*a*, 31*b*) that are consecutive from the upstream side. Solid images of the composite colors RGB are thereby printed with the same conditions. Alternatively, if one printer 1 is used and inks are discharged in the order CMYC from the upstream side from the four heads (31*a* to 31*d*) without using K ink, the composite colors B, R, and G can be printed consecutively so as to be the same with one printer 1; B being printed from the first and second heads from the upstream side, R being printed from the second and third heads, and G being printed from the third and fourth heads.

Next, the solid areas of composite colors printed in this manner are converted to image data by using a scanner or the like, and the image data is analyzed, thereby detecting the concentrations of pixels in the solid areas of the respective composite colors, the concentration differences between pixels, and other characteristics (s2). The relationship of the magnitude of concentration irregularity between the composite colors is thereby determined (s3). Of course, if there is a large difference in concentration, it is even possible to visually determine the relationship of the magnitude of concentration irregularity. In this description, concentration irregularity is greater in the order B, R, G.

Lastly, the discharge order of inks is established based on the relationship of the magnitude of concentration irregularity (s4). Specifically, there is the greatest amount of separation in discharge order between Y ink and C ink, which constitute the composite color G having the greatest difference of concentration. These two colors correspond to the first head 31*a* and the fourth head 31*d* from the upstream side. The first head is made to discharge C ink, and the fourth head 31*d* is made to discharge Y ink. Next, there must be separation between M ink and Y ink, which constitute the composite color R having large concentration irregularity. Since Y ink has already been discharged by the fourth head 31*d*, M ink is automatically allocated to the second head 31*b*. That is, K ink is discharged between M ink and Y ink.

Figure 6:
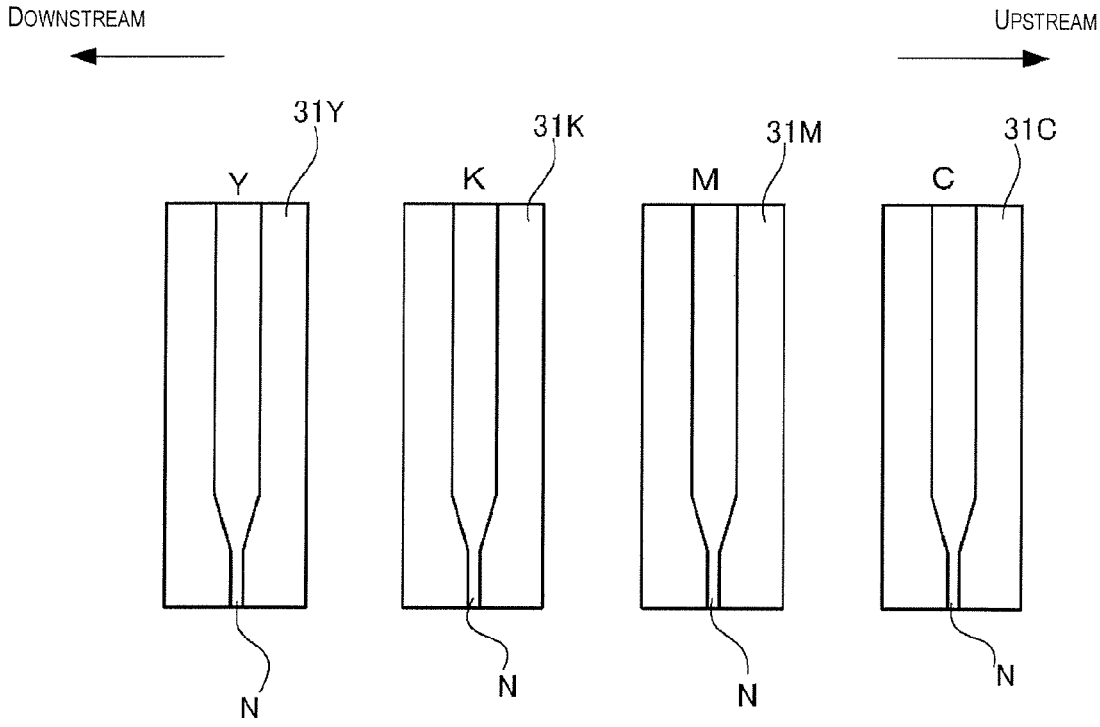
FIG. 6 is a drawing showing the arrangement of heads based on the conditions set according to the method of the first working example.

As described above, the print conditions are set with the four heads (31*a* to 31*d*) designated as discharging the respective colors C, M, K, Y in order from the upstream side (s5). The sequence may of course be reversed, with the colors aligned Y, K, M, C from the upstream side. The final product is preferably designed such that the heads (31*a* to 31*d*) and the inks correspond to each other based on this setting, and the tanks corresponding to the heads (31*a* to 31*d*) are filled with the inks of the respective corresponding colors. FIG. 6 shows the correlation between the heads and inks set up based on the specific example described above. The heads (31C, 31M, 31Y, 31K) corresponding to the inks CMYK are disposed in the order C, M, K, Y from the upstream side.

Thus, according to the print condition setting method in the printing device according to the present working example, concentration irregularity countermeasures can be taken that are suited to the design of the printing device, conventionally used inks and media can be used without modifications, concentration irregularity can be reliably prevented without incurring large development costs, and a higher quality and less expensive printing device can be provided.

Second Working Example

In the print condition setting method according to the first working example, the very design of the printer 1 as a product is altered, but the user does not essentially alter the design. Rather, the user cannot alter the design. However, with printers having commercial applications such as printing posters or the like, it is often the case that the commercial product, which is a single image, is printed in large amounts, and when the necessary amount of this commercial image has been printed, another commercial image is similarly printed in large amounts, and the procedure is repeated. With this type of commercial application, the demand is for printing at a higher image quality, and causes of poor image quality other than concentration irregularity must therefore also be resolved. For example, there are also cases in which it is preferable to not follow the print settings based on the method of the first working example if the image quality is poor owing to the discharge order of K ink. In view of this, an example of the second working example is a method for setting conditions that enable printing of the highest quality in view of concentration irregularity and other causes of poor image quality, in accordance with the contents of the image to be printed.

First, using a printer 1 whose conditions have been set based on the first working example, the image to be printed (an image or the like having the same specifications as a poster) is printed experimentally. The image is then analyzed. As a result, for example, if the G printing area is extremely small and it is determined that more priority should be given to resolving the loss of image quality from causes other than concentration irregularity in the G printing area, the relationship of the magnitude of concentration irregularity between R and B is preferably the only issue dealt with.

Figure 7A:
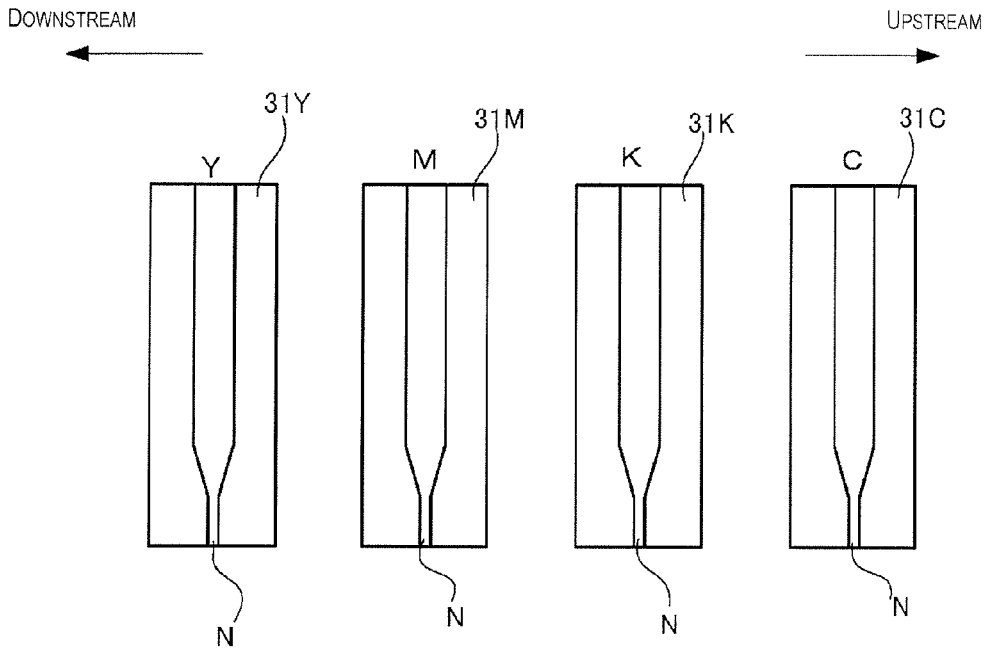
FIGS. 7A and 7B are drawings showing an example of the head arrangement based on the conditions set according to the print condition setting method according to the second working example of the present invention.
Figure 7B:
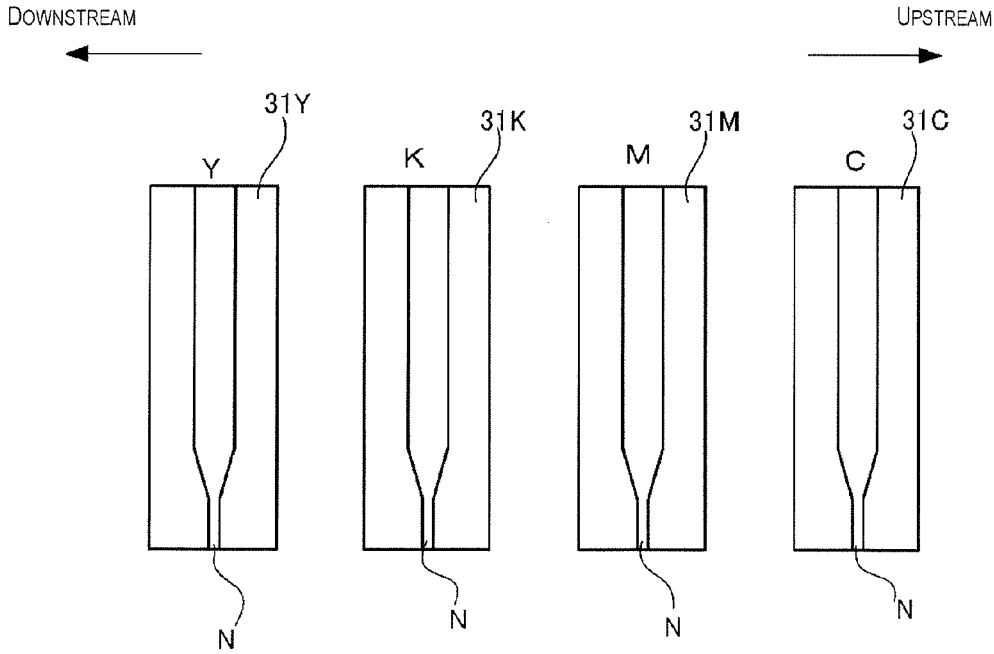
Figure 8A:
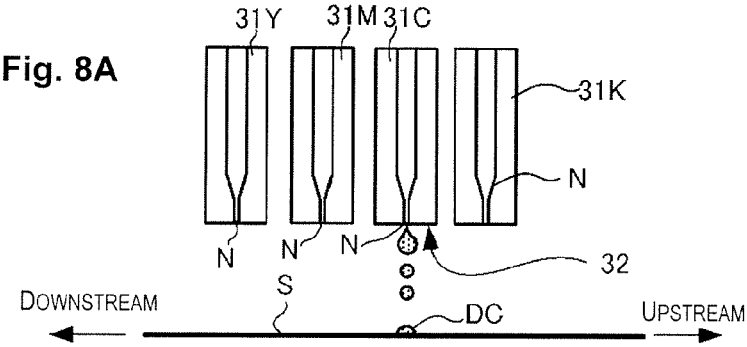
FIGS. 8A to 8D are drawings showing an example of a control method for modifying the ink discharge order in the printer.
Figure 8B:
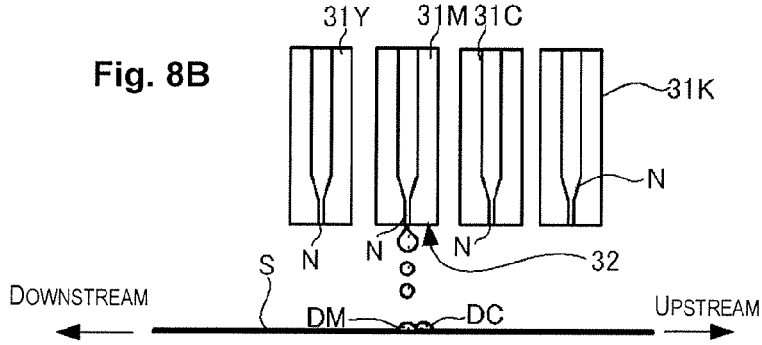
Figure 8C:
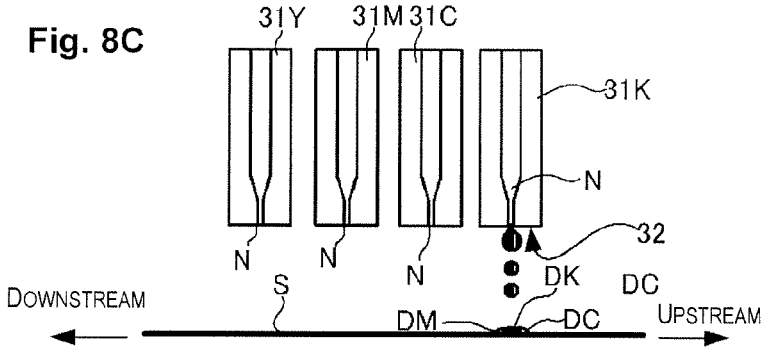
Figure 8D:
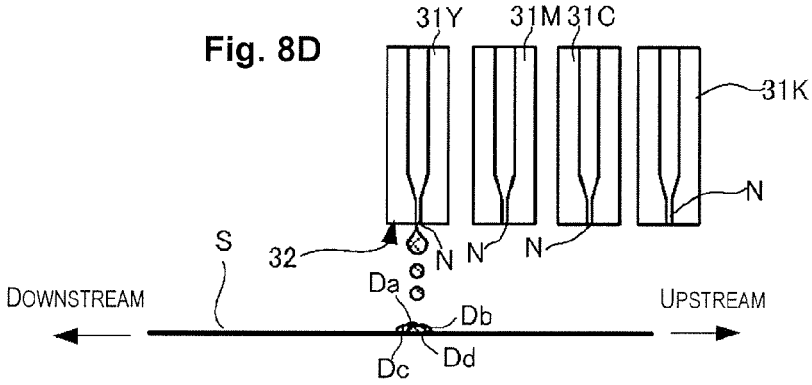

Specifically, in cases in which the G concentration irregularity is not dealt with according to the image specifics even though an image including solid areas has been analyzed in advance and it is already known that concentration irregularity increases in the order B, R, G, first priority is given to the R concentration irregularity countermeasures over the discharge sequence of Y ink and M ink constituting G, and there is greatest separation between the discharge orders of C ink and Y ink constituting R, as shown in FIG. 7A. C ink is discharged from the first head 31C from the upstream side, and Y ink is discharged from the fourth head 31Y. Next, to create separation in the discharge orders of M ink and C ink constituting B, the head 31K for K ink is disposed between the heads (31C, 31Y) corresponding to these M and C inks. To deal with the extent of concentration irregularity, the initial order G, R, B may be changed to R, G, B, and the heads (31C, 31M, 31K, 31Y) may be disposed in the order of the inks C, M, K, Y from the upstream side as shown in FIG. 7B.

Of course, the images including solid areas do not need to be analyzed and the relationship of the magnitude of concentration irregularity in the composite colors RGB do not need to be established in advance. The inks may be first discharged in the desired order to experimentally print the image to be printed, and the relationship of the magnitude of concentration irregularity unique to this image may be specified based on the results of this image analysis. The ink discharge order may then be established based on the relationship of the magnitude of concentration irregularity unique to this image.

Modifying the Discharge Order

In the second working example, the user had modified the discharge order of the inks. In view of this, to adapt the printer 1 to the second working example, the printer 1 must have a function that enables the discharge order to be modified (discharge ink modification function). To give a specific description based on FIG. 2, a configuration in which the heads (31*a* to 31*d*) themselves can be replaced freely by the user, for example, is first considered as a discharge ink modification function. With this configuration, the user can set the discharge order of the colored inks as desired by mounting the heads (31*a* to 31*d*) for desired ink colors in the desired order from the upstream side.

Valves or the like capable of freely switching the inflow and outflow paths may be placed midway through the ink flow passages running from the ink tanks to the heads (31*a* to 31*d*), and the flow passages running from the ink tanks filled with colored inks to the heads (31*a* to 31*d*) may be freely switched. Inks of the desired colors can thereby be discharged from the desired heads (31*a* to 31*d*).

In many inkjet printers, ink is supplied to the heads (31*a* to 31*d*) by using ink cartridges that can be easily removed by a user. In view of this, the design can be set up so that ink of the desired color can be discharged from the desired head (31*a* to 31*d*) if the installed position of the cartridge is changed. When the flow passages are switched or the installed positions of the ink cartridges are changed and the correlation between the inks and heads is recalibrated, the remaining ink that was being discharged in the flow passage must be washed out before the newly assigned ink is discharged. This flow passage washing may be suitably performed prior to printing by discharging the new ink and discarding the ink that had remained in the flow passage, or by flowing an ink solution referred to as clear ink through the flow passage.

In the second working example, the image to be printed was actually printed and analyzed, but another possible option is to establish the discharge order of the inks on the basis of print data for creating the image without printing the image. For example, if the print data is analyzed, the surface area ratio and other characteristics of the composite colors RGB can be determined, and it is possible to determine in advance whether or not there are images where concentration irregularity is easily noticeable. The discharge order of the inks is then preferably set according to the determination results. Specifically, software specifically designed for analyzing the print data is installed in advance in the PC 110 which creates the print data. When the image data to be printed is indicated in the PC 110, the print data for the image is created. The PC 110 does not cause the printer 1 to perform the printing action, but analyzes the print data and establishes the discharge order of the colored inks. The printer 1 may be controlled based on the result to perform the washing action or the subsequent flow passage switching action, and a display of the installed positions of the colored ink cartridges may be outputted to the user.

The ink discharge order can be modified by accurately controlling the position of the medium S and the ink discharge timing in synchronization with the conveying of the medium, even if the arrangement of the heads (31*a* to 31*d*) or the correlation between the inks and the heads (31*a* to 31*d*) is not modified. For example, the heads (31K, 31C, 31M, 31Y) for the inks are arranged in the order K, C, M, Y from the upstream side and droplets are deposited on predetermined positions in the order C, M, K, Y, as in the printing procedure shown in FIGS. 8A through 8D. In such cases, first, the medium S is conveyed downstream to the position of the C ink head 31C, where C ink is discharged onto a predetermined position on the medium S (A), and the medium S is then conveyed downstream to the position of the M ink head 31M, where M ink is discharged (B). Next, the medium S is conveyed upstream in the opposite direction, and K ink is discharged by the K ink head 31K (C). Lastly, the conveying direction is again reverse to convey the medium S downstream, and ink is discharged by the Y ink head 31Y. Thus, the ink discharge order can be modified by accurately controlling the conveying of the medium S and the discharge of ink by the heads (31K, 31C, 31M, 31Y) in synchronization with each other. There is thereby no need to modify the hardware configuration of the printing device, and the printing device can be provided inexpensively. There is also no need to replace the ink in order to modify the correlation between the inks and the heads. Therefore, the clear ink needed for the washing action and the discarding of ink are substantially eliminated, and running costs can also be reduced.

Other Embodiments of the Printing Device

For the printer 1 in the embodiment described above, an example of a piezo-type inkjet printer was presented in which fluid is ejected by applying voltage to drive elements (piezo elements) to expand and contract ink chambers, but the liquid discharge system is not limited to this example and may be a thermal system in which heat-generating elements are used to create air bubbles in the nozzles and the liquid is ejected by the air bubbles.

The medium is not limited to paper, and may be cloth, a label surface of an optical disk (CD-R or the like), a substrate, or any type of medium on which printing is performed by ink. Of course, the medium may be anything continuously conveyed such as roll paper, or anything conveyed individually such as cut sheet paper.

The present invention can be applied to an inkjet printer or another printing device which forms an image by depositing droplets of discharged ink onto a medium, for example.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A method for setting print conditions in a printing device including a conveying mechanism of a medium and a plurality of heads for discharging inks out of nozzles, the inks including at least black ink and inks of the three colors including cyan, magenta, and yellow, wherein heads extend across the width of the medium in a line direction orthogonal to the conveying direction of the medium, the heads are disposed in parallel from an upstream side to a downstream side, and a color image is formed by ink droplets being discharged in order from the heads and deposited on the medium while the medium is being conveyed, the print condition setting method in a printing device comprising:

setting an order of the extent of concentration irregularity for three composite colors including red, green, and blue expressed by combining two of the three colored inks; and creating the most separation between the two colored inks that express the composite color having the greatest concentration irregularity, based on the order for discharging the black ink and the three colored inks in the printing device, and placing the discharge order of the black ink between the two colored inks that express the composite color having the second greatest concentration irregularity.

2. The print condition setting method in a printing device according to claim 1, wherein the setting of the order of the extent of concentration irregularity concentration irregularity includes printing a test image containing individual print areas of the composite colors including red, green, and blue over a predetermined surface area on the medium, and analyzing the test image to detect the extent of concentration irregularity in the print area of the composite colors.

3. The print condition setting method in a printing device according to claim 1, further comprising printing a desired image indicated by a user, and analyzing the desired image to detect the extent of concentration irregularity of the composite colors, the placing of the discharge order including analyzing the desired image to set the order in accordance with the extent of the concentration irregularity.

4. The print condition setting method in a printing device according to claim 1, wherein the printing device comprises a head-switching mechanism configured to discharge the desired ink color in the desired head according to an operation of the user.

5. The print condition setting method in a printing device according to claim 4, further comprising outputting to the user a display of the discharge order set in the placing of the discharge order.

6. The print condition setting method in a printing device according to claim 1, wherein the conveying mechanism can convey the medium in two directions, the heads corresponding to the respective inks of cyan, magenta, yellow and black are arranged in a predetermined order from the upstream side to the downstream side, and in t the placing of the discharge order, the medium is conveyed according to the discharge order in forward and reverse directions to ink discharge positions of the heads corresponding to the respective inks of cyan, magenta, yellow and black.

* * * * *